US007121926B2

(12) United States Patent
Sabde

(10) Patent No.: US 7,121,926 B2
(45) Date of Patent: Oct. 17, 2006

(54) METHODS FOR PLANARIZATION OF GROUP VIII METAL-CONTAINING SURFACES USING A FIXED ABRASIVE ARTICLE

(75) Inventor: Gundu M. Sabde, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 3 days.

(21) Appl. No.: 10/028,616

(22) Filed: Dec. 21, 2001

(65) Prior Publication Data

US 2003/0119426 A1 Jun. 26, 2003

(51) Int. Cl.
*B24B 1/00* (2006.01)

(52) U.S. Cl. ..... 451/41; 451/36; 451/60; 451/286; 451/287; 451/288; 451/446; 428/680; 428/692

(58) Field of Classification Search ..... 428/650, 428/692, 6.8; 451/36, 41, 60, 286, 287, 288, 451/446
See application file for complete search history.

(56) References Cited

U.S. PATENT DOCUMENTS

| | | | | |
|---|---|---|---|---|
| 4,035,500 | A | 7/1977 | Dafter, Jr. | |
| 4,297,436 | A | 10/1981 | Kubotera et al. | |
| 4,670,306 | A | 6/1987 | Salem | |
| 4,747,907 | A | 5/1988 | Acocella et al. | |
| 4,992,137 | A | 2/1991 | Cathey, Jr. et al. | |
| 5,254,217 | A | 10/1993 | Maniar et al. | |
| 5,318,927 | A | 6/1994 | Sandhu et al. | |
| 5,378,492 | A | 1/1995 | Mashiko | |
| 5,380,401 | A | 1/1995 | Jones et al. | |
| 5,392,189 | A | 2/1995 | Fazan et al. | |
| 5,480,854 | A | 1/1996 | Rajaram et al. | |
| 5,527,423 | A * | 6/1996 | Neville et al. | 158/636.1 |
| 5,575,885 | A | 11/1996 | Hirabayashi et al. | |
| 5,692,950 | A | 12/1997 | Rutherford et al. | |
| 5,695,384 | A | 12/1997 | Beratan | |
| 5,700,383 | A | 12/1997 | Feller et al. | |
| 5,711,851 | A | 1/1998 | Blalock et al. | |
| 5,786,259 | A | 7/1998 | Kang | |
| 5,888,906 | A | 3/1999 | Sandhu et al. | |
| 5,916,855 | A | 6/1999 | Avanzino et al. | |
| 5,935,871 | A | 8/1999 | Farkas et al. | |
| 5,954,997 | A | 9/1999 | Kaufman et al. | |
| 5,958,794 | A | 9/1999 | Bruxvoort et al. | |
| 5,976,928 | A | 11/1999 | Kirlin et al. | |
| 5,981,454 | A | 11/1999 | Small | |

(Continued)

FOREIGN PATENT DOCUMENTS

EP 1 111 083 6/2001

(Continued)

OTHER PUBLICATIONS

Weast et al., "CRC Handbook of Chemistry and Physics," *Chemical Rubber Publishing Company*, 1989: D151-154.

(Continued)

*Primary Examiner*—Lee D. Wilson
*Assistant Examiner*—Shantese McDonald
(74) *Attorney, Agent, or Firm*—Mueting, Raasch & Gebhardt, P.A.

(57) ABSTRACT

A planarization method includes providing a Group VIII metal-containing surface (preferably, a platinum-containing surface) and positioning it for contact with a fixed abrasive article in the presence of a planarization composition, wherein the fixed abrasive article comprises a plurality of abrasive particles having a hardness of no greater than about 6.5 Mohs dispersed within a binder adhered to at least one surface of a backing material.

34 Claims, 4 Drawing Sheets

U.S. PATENT DOCUMENTS

| | | | | |
|---|---|---|---|---|
| 5,989,988 | A | 11/1999 | Iinuma et al. | |
| 6,015,506 | A | 1/2000 | Streinz et al. | |
| 6,039,633 | A | 3/2000 | Chopra | |
| 6,045,716 | A | 4/2000 | Walsh et al. | |
| 6,069,080 | A * | 5/2000 | James et al. | 438/691 |
| 6,071,816 | A | 6/2000 | Watts et al. | |
| 6,110,830 | A | 8/2000 | Skrovan et al. | |
| 6,143,191 | A | 11/2000 | Baum et al. | |
| 6,143,192 | A | 11/2000 | Westmoreland | |
| 6,149,828 | A | 11/2000 | Vaartstra | |
| 6,211,034 | B1 | 4/2001 | Visokay et al. | |
| 6,261,157 | B1 * | 7/2001 | Bajaj et al. | 451/57 |
| 6,278,153 | B1 | 8/2001 | Kikuchi et al. | |
| 6,290,736 | B1 | 9/2001 | Evans | |
| 6,306,012 | B1 | 10/2001 | Sabde | |
| 6,346,741 | B1 | 2/2002 | Van Buskirk et al. | |
| 6,368,518 | B1 | 4/2002 | Vaartstra | |
| 6,379,406 | B1 | 4/2002 | Thomas et al. | |
| 6,395,194 | B1 * | 5/2002 | Russell et al. | 252/79.1 |
| 6,436,723 | B1 | 8/2002 | Tomita et al. | |
| 6,451,214 | B1 | 9/2002 | Westmoreland | |
| 6,454,957 | B1 | 9/2002 | Westmoreland | |
| 6,476,491 | B1 | 11/2002 | Harada et al. | |
| 6,527,622 | B1 | 3/2003 | Brusic et al. | |
| 6,527,818 | B1 | 3/2003 | Hattori et al. | |
| 6,537,462 | B1 | 3/2003 | Westmoreland | |
| 6,589,100 | B1 | 7/2003 | Moeggenborg et al. | |
| 6,641,631 | B1 | 11/2003 | Thomas et al. | |
| 6,730,592 | B1 | 5/2004 | Vaartstra | |
| 6,756,308 | B1 | 6/2004 | Small et al. | |
| 6,840,971 | B1 | 1/2005 | Wang et al. | |
| 6,841,479 | B1 | 1/2005 | Cherian et al. | |
| 6,861,353 | B1 | 3/2005 | Vaartstra | |
| 2001/0006031 | A1 | 7/2001 | Tsuchiya et al. | |
| 2001/0023701 | A1 | 9/2001 | Aoki et al. | |
| 2002/0008265 | A1 | 1/2002 | Beitel et al. | |
| 2002/0017063 | A1 | 2/2002 | Beitel et al. | |
| 2002/0019088 | A1 | 2/2002 | Basceri et al. | |
| 2002/0039839 | A1 | 4/2002 | Thomas et al. | |
| 2002/0042208 | A1 | 4/2002 | Beitel et al. | |
| 2002/0050322 | A1 | 5/2002 | Kunisawa et al. | |
| 2002/0081853 | A1 | 6/2002 | Beitel et al. | |
| 2002/0111026 | A1 | 8/2002 | Small et al. | |
| 2002/0111027 | A1 | 8/2002 | Sachan et al. | |
| 2002/0151177 | A1 | 10/2002 | Cherian et al. | |
| 2003/0119316 | A1 | 6/2003 | Klein et al. | |
| 2003/0119319 | A1 | 6/2003 | Sinha et al. | |
| 2003/0119321 | A1 | 6/2003 | Uhlenbrock et al. | |
| 2003/0121891 | A1 | 7/2003 | Westmoreland | |
| 2003/0166337 | A1 | 9/2003 | Wang et al. | |
| 2004/0157458 | A1 | 8/2004 | Vaartstra | |

FOREIGN PATENT DOCUMENTS

| | | |
|---|---|---|
| EP | 1 123 956 | 8/2001 |
| EP | 1 156 091 | 11/2001 |
| JP | 2000 200782 | 7/2000 |
| WO | WO 98/06541 | 2/1998 |
| WO | WO 98/36045 | 8/1998 |
| WO | WO 99/27581 | 6/1999 |
| WO | WO 99/553532 | 10/1999 |
| WO | WO 00/31794 | 6/2000 |
| WO | WO 00/77107 | 12/2000 |
| WO | WO 01/44396 | 6/2001 |
| WO | WO 02/084718 | 10/2002 |
| WO | WO 03/056620 | 7/2003 |
| WO | WO 03/059571 | 7/2003 |
| WO | WO 03/060028 | 7/2003 |
| WO | WO 03/060980 | 7/2003 |

OTHER PUBLICATIONS

Webster's II New Riverside University Dictionary, 1984: 258, 842.

U.S. Appl. No. 11/058,140, filed Feb. 15, 2005, Vaartstra.

U.S. Appl. No. 11/081,413, filed Mar. 16, 2005, Sinha et al.

Canterford et al., "Chapter 9: Rhodium and Iridium, " *Halides of the Transition Elements, Halides of the Second and Third Row Transition Metals*, John Wiley & Sons, New York, NY, 1968; pp. 346-357, publication p., title p. (14 pages total).

DeOrnellas et al., "Challenges for Plasma Etch Integration of Ferroelectric Capacitors in FeRAM's and DRAM's," *Integrated Ferroelectrics*, 1997;17:395-402.

DeOrnellas et al., "Plasma Etch of Ferroelectric Capacitors in FeRAMs and DRAMs," *Semiconductor International*, Sep. 1997; pp. 103-104, 106 and 108.

Ginzburg et al., *Analytical Chemistry of Platinum Metals*John Wiley & Sons, New York, cover p., and 14-15.

Kim et al., "Chemical Dry Etching of Platinum Using $Cl_2$/CO Gas Mixture," *Chem. Mater.*, 1998;10:3576-3582.

Kwon et al., "Etching properties of Pt thin films by inductively coupled plasma," *J. Vac. Sci. Technol.*, 1998;A 16(5):2772-6.

Nakao, "Dissolution of Noble Metals in Halogen-Halide-Polar Organic Solvent Systems," *J. Chem. Soc., Chem. Commun.*, Mar. 1, 1992; 5:426-7.

Wilberg, *Lehrbuch der Anorganischen Chemie*, Walter de Gruyter, Berlin, 1985, Cover p., and 1188.

Xu et al., "Chemical Vapor Deposition (CVD) of Iridium and Platinum Films and Gas-Phase Chemical Etching of Iridium Thin Films," *Mat. Res. Soc. Symp. Proc.*, 1999;541:129-139.

Wilberg, "Chapter XXX, No. 4: Chemical Properties," *Lehrbuch der Anorganischen Chemie*, Walter de Gruyter, Berlin, 1985, p. 1118 (Translation of First paragraph only).

* cited by examiner

METHODS FOR PLANARIZATION OF GROUP VIII METAL-CONTAINING SURFACES USING A FIXED ABRASIVE ARTICLE

FIELD OF THE INVENTION

The present invention relates to methods for planarization of Group VIII metal-containing (preferably, platinum-containing) surfaces, particularly in the fabrication of semiconductor devices.

BACKGROUND OF THE INVENTION

During fabrication of semiconductor devices, various surfaces are formed. Many of such surfaces do not have uniform height, and therefore, the wafer thickness is also non-uniform. Further, surfaces may have defects such as crystal lattice damage, scratches, roughness, or embedded particles of dirt or dust. For various fabrication processes to be performed, such as lithography and etching, height non-uniformities and defects at the surface of the wafer must be reduced or eliminated. Various planarization techniques are available to provide such reduction and/or elimination. One such planarization technique includes mechanical and/or chemical-mechanical polishing (abbreviated herein as "CMP").

The process of planarization is used to remove material, and preferably achieve a planar surface, over the entire chip and wafer, sometimes referred to as "global planarity." Conventionally, the process of planarization, and particularly CMP, involves the use of a wafer carrier that holds a wafer, a polishing pad, and an abrasive slurry that includes a dispersion of a plurality of abrasive particles in a liquid. The abrasive slurry is applied so that it contacts the interface of the wafer and the polishing pad. A table or platen has a polishing pad thereon. The polishing pad is applied to the wafer at a certain pressure to perform the planarization. At least one of the wafer and a polishing pad are set in motion relative to the other. In some planarization processes, the wafer carrier may or may not rotate, the table or platen may or may not rotate and/or the platen may be moved in a linear motion as opposed to rotating. There are numerous types of planarization units available which perform the process in different manners.

The use of abrasive slurries in wafer fabrication has proven problematic for several reasons. First, abrasive slurries that contain a plurality of abrasive particles in a dispersion tend to be unstable. In particular, not only do the abrasive particles settle, the abrasive particles also tend to agglomerate, both phenomenon resulting in a nonuniform slurry composition. This, in turn, creates wide variability in the polishing results. Second, it is known within the art that the composition of the slurry tends to be very specific with the desired planarization process, i.e., one slurry may not be suitable for a variety of processes.

Also, conventional polishing pads pose planarization difficulties. Such pads may glaze, or become embedded with debris, during planarizing. This requires the pads to be conditioned such that the pads can be reused. Conditioning typically involves removal of the debris from the polishing pad using mechanical means with or without application of a solution. Conditioned pads typically lead to subsequent unpredictable planarization results because of the unpredictability in removal of debris from the pad itself during conditioning.

Fixed abrasive articles used in place of conventional polishing pads are also known and used in planarization processes. Such fixed abrasive articles include a plurality of abrasive particles dispersed within a binder adhered to at least one surface of a backing material. For certain situations, fixed abrasive articles are advantageous; however, conventional abrasive slurries are typically incompatible with fixed abrasive articles for many planarization processes.

The planarization of a surface that includes platinum and other Group VIII metals typically involves more mechanical than chemical action during a polishing process because they are relatively chemically inert and/or have relatively few volatile produces. Such mechanical polishing uses alumina and silica particles. Unfortunately, mechanical polishing tends to cause the formation of defects (e.g., scratches and particles), both of which can be detected optically, rather than the clean removal of the platinum.

Thus, there is still a need for methods for planarizing an exposed surface of a substrate that includes platinum and other Group VIII metals, particularly in the fabrication of semiconductor devices.

SUMMARY OF THE INVENTION

The present invention provides methods that overcome many of the problems associated with the planarization of a surface that includes platinum and/or another of the Group VIII second and third row metals (i.e., Groups 8, 9, and 10, preferably, Rh, Ru, Ir, Pd, and Pt). Such a surface is referred to herein as a platinum-containing surface, or more generally, a Group VIII metal-containing surface. A "Group VIII metal-containing surface" refers to an exposed region having a Group VIII metal (particularly, platinum) preferably present in an amount of at least about 10 atomic percent, more preferably at least about 20 atomic percent, and most preferably at least about 50 atomic percent, of the composition of the region, which may be provided as a layer, film, coating, etc., to be planarized (e.g., via chemical-mechanical or mechanical planarization or polishing) in accordance with the present invention. The surface preferably includes (and more preferably, consists essentially of) one or more Group VIII metals in elemental form or an alloy thereof (with each other and/or one or more other metals of the Periodic Table). That is, the surface does not include significant amounts of nonmetals such as silicon or oxygen atoms, as occur in a silicide or oxide.

The methods of the present invention involve planarizing a surface. Herein, as is conventionally understood, "planarizing" or "planarization" refers to the removal of material from a surface, whether it be a large or small amount of material, either mechanically, chemically, or both. This also includes removing material by polishing. As used herein, "chemical-mechanical polishing" and "CMP" refer to a dual mechanism having both a chemical component and a mechanical component, wherein corrosion chemistry and fracture mechanics both play a roll in the removal of material, as in wafer polishing.

In one aspect of the present invention, a planarization method is provided that includes: positioning a Group VIII metal-containing surface of a substrate (preferably, a semiconductor substrate or substrate assembly such as a wafer) to interface with a fixed abrasive article; supplying a planarization composition in proximity to the interface; and planarizing the Group VIII metal-containing surface using the fixed abrasive article. The Group VIII metal is selected from the group consisting of rhodium, iridium, ruthenium, osmium, palladium, platinum, and combinations thereof. The fixed abrasive article includes a plurality of abrasive particles having a hardness of no greater than about 6.5 Mohs dispersed within a binder adhered to at least one surface of a backing material.

In another aspect of the present invention, a planarization method is provided that includes: providing a semiconductor substrate or substrate assembly including at least one region of a platinum-containing surface (preferably, a surface having a nonplanar topography); providing a fixed abrasive article; providing a planarization composition (preferably, including an oxidizing agent and/or a complexing agent, more preferably, an oxidizing agent) at an interface between the at least one region of platinum-containing surface and the fixed abrasive article; and planarizing the at least one region of platinum-containing surface with the fixed abrasive article; wherein the fixed abrasive article comprises a plurality of abrasive particles having a hardness of no greater than about 6.5 Mohs dispersed within a binder adhered to at least one surface of a backing material.

As used herein, "semiconductor substrate or substrate assembly" refers to a semiconductor substrate such as a base semiconductor layer or a semiconductor substrate having one or more layers, structures, or regions formed thereon. A base semiconductor layer is typically the lowest layer of silicon material on a wafer or a silicon layer deposited on another material, such as silicon on sapphire. When reference is made to a substrate assembly, various process steps may have been previously used to form or define regions, junctions, various structures or features, and openings such as vias, contact openings, high aspect ratio openings, conductive regions, contact regions, etc. For example, a substrate assembly may refer to a structure upon which a metallization is to be performed, e.g., metal lines are formed for electrical interconnection functionality.

Yet another aspect of the present invention provides a planarization method for use in forming a capacitor or barrier layer. Preferably, the method includes: providing a wafer having a patterned dielectric layer formed thereon and a Group VIII metal-containing layer formed over the patterned dielectric layer, wherein the Group VIII metal is selected from the group consisting of rhodium, iridium, ruthenium, osmium, palladium, platinum, and combinations thereof; positioning a first portion of a fixed abrasive article for contact with the platinum-containing layer; providing a planarization composition in proximity to the contact between the fixed abrasive and the Group VIII metal-containing layer; and planarizing the platinum-containing layer with the fixed abrasive article; wherein the fixed abrasive article comprises a plurality of abrasive particles having a hardness of no greater than about 6.5 Mohs dispersed within a binder adhered to at least one surface of a backing material.

In any of the methods in accordance with the present invention, the fixed abrasive article preferably includes a plurality of abrasive particles such as $CeO_2$ particles, $Y_2O_3$ particles, $Fe_2O_3$ particles, or mixtures thereof. More preferably, a majority of the plurality of abrasive particles are $CeO_2$ abrasive particles.

In any of the methods in accordance with the present invention, the planarization composition does not typically include abrasive particles. Alternatively, and preferably, the planarization composition includes an oxidizing agent, a complexing agent, or mixtures thereof.

DETAILED DESCRIPTION OF PREFERRED EMBODIMENTS

Figure 1A:
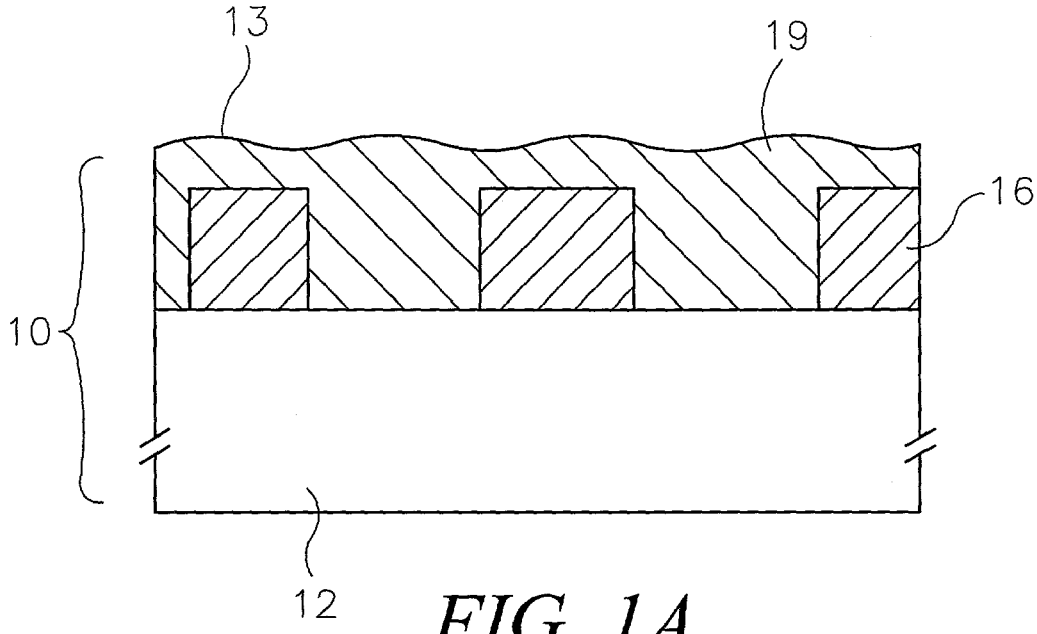
FIGS. 1A and 1B are cross-sectional illustrations of one portion of a wafer before and after a planarization process has been performed in accordance with the present invention.

The present invention provides methods of planarization of a surface that includes platinum and/or one or more of the other second or third row Group VIII metals. The Group VIII metals are also referred to as the Group VIIIB elements or transition metals of Groups 8, 9, and 10 of the Periodic Table. The second and third row Group VIIIB metals include Rh, Ru, Ir, Pd, Pt, and Os. Preferably, surfaces that include Rh, Ru, Ir, Pd, and/or Pt can be planarized according to methods of the present invention. Such a surface is referred to herein as a Group VIII metal-containing surface (this refers to those containing second and/or third row transition metals).

Preferably, a "Group VIII metal-containing surface" refers to an exposed region having a Group VIII metal (particularly, platinum) present in an amount of at least about 10 atomic percent, more preferably at least about 20 atomic percent, and most preferably at least about 50 atomic percent, of the composition of the region, which may be provided as a layer, film, coating, etc., to be planarized (e.g., via chemical-mechanical or mechanical planarization or polishing) in accordance with the present invention.

The planarization of such surfaces, particularly a surface that includes platinum, typically involves mechanical methods with relatively hard particles such as alumina ($Al_2O_3$) and silica ($SiO_2$) particles, which can cause smearing and the formation of defects rather than the clean removal of the material. Surprisingly, the use of a fixed abrasive article that includes abrasive particles having a hardness of no greater than about 6.5 Mohs reduces, and often eliminates, the problems of smearing and defect formation. Such particles include, for example, ceria ($CeO_2$), which has a hardness of about 6.0 Mohs, as well as yttrium oxide ($Y_2O_3$), which has a hardness of about 5.5 Mohs, and ferric oxide ($Fe_2O_3$), which has a hardness of about 6.0 Mohs. This is in contrast to alumina abrasive particles, which have a hardness ranging from about 8.5 Mohs to about 9.0 Mohs, and silica abrasive particles, which have a hardness ranging from about 7.5 Mohs.

Fixed abrasive articles that include a plurality of abrasive particles having a hardness of no greater than about 6.5 Mohs can be used with or without a planarization composition, and thus, in a variety of planarization processes, including mechanical or chemical-mechanical. In any of the methods in accordance with the present invention, the fixed abrasive preferably includes a plurality of $CeO_2$ particles, $Y_2O_3$, $Fe_2O_3$, or mixtures thereof. More preferably, a majority of the plurality of abrasive particles are $CeO_2$ particles.

Typically, the abrasive particles range in particle size (i.e., the largest dimension of the particle) on average from about 10 nanometers (nm) to about 5000 nm, and more often about 30 nm to about 1000 nm. For preferred embodiments, suitable abrasive particles have an average particle size of about 100 nm to about 300 nm.

Significantly, the methods of the present invention are particularly advantageous in planarizing a surface that includes a "nonplanar" (i.e., "nonflat") topography, i.e., a surface that includes regions of greater height than other regions of the surface. Examples of surfaces that have a nonplanar topography include those that have undulating layers or those with structures such as in capacitors. Typically, "nonplanar" (i.e., "nonflat") surfaces have regions that are at least about 200 Angstroms higher, preferably, at least about 500 Angstroms higher, and more preferably, at least about 2000 Angstroms higher, than other regions of the surface. The fixed abrasive articles used in the methods of the present invention contribute to a higher rate of removal of material from surfaces having a nonplanar topography when compared to surfaces that are planar or flat (e.g., a blanket layer in a semiconductor substrate assembly, or other surfaces having regions that are less than about 200 Angstroms in height differential). Preferably, the rate of removal of material from a surface that has a nonplanar topography is at least about 10 times, and often as much as about 25 times, that of the rate of removal of material from a generally planar or flat surface.

Significantly, the methods of the present invention are particularly advantageous in removing platinum or other Group VIII metals from a surface in preference to other materials, particularly silicon dioxide. This is important in selectively removing material from platinum-containing or other Group VIII metal-containing layers without removing, for example, significant amounts of underlying layers, such as oxide layers (e.g., TEOS or BPSG layers). Preferably, the selectivity for removal of material from a Group VIII metal-containing surface having a nonplanar topography, wherein the Group VIII metal is in elemental form (including alloys), relative to material from a dielectric layer (e.g., silicon dioxide, silicon nitride, BPSG) is within a range of about 10:1 to about 25:1, depending on the chemistry and process conditions. This selectivity ratio can be increased even further with the use of planarization compositions including one or more oxidizing agents and or complexing agents, for example. By comparison, the selectivity for removal of material from a Group VIII metal-containing planar (i.e., flat) surface relative to material from an oxide-containing surface is about 1:1, using the same fixed abrasive article and process conditions.

For enhancing selectivity, a planarization composition is preferably used in the methods of the present invention. Preferably, a suitable composition includes an oxidizing agent and/or complexing agent (more preferably an oxidizing agent) to aid in the planarization, as well as other additives such as a surfactant to enhance wettability and reduce friction, a thickener to achieve a desired viscosity, a buffering agent to achieve a desire pH, etc. Preferably, the composition is an aqueous solution of these components. More preferably, the planarization composition has a pH of about 1.5 to about 3. Preferred oxidizing agents (i.e., oxidants) include, for example, ceric ammonium nitrate, ceric ammonium sulfate, etc. Examples of suitable planarization compositions are disclosed in Applicant's Assignee's copending U.S. patent applications: Ser. No. 10/028,249, filed on Dec. 21, 2001 entitled METHODS FOR PLANARIZATION OF GROUP III METAL-CONTAINING SURFACES USING OXIDIZING AGENTS; Ser. No. 10/028,040, filed on Dec. 21, 2001 entitled METHODS FOR PLANARIZATION OF GROUP VIII METAL-CONTAINING SURFACES USING COMPLEXING AGENTS; and Ser. No. 10/032,357, filed on Dec. 21, 2001 entitled METHODS FOR PLANARIZATION OF GROUP VIII METAL-CONTAINING SURFACES USING OXIDIZING GASES.

A suitable fixed abrasive for use in the present invention is known, such as that described in U.S. Pat. No. 5,692,950 (Rutherford, et al.) and International Patent Publication WO 98/06541. In general, a fixed abrasive includes a plurality of abrasive particles dispersed within a binder that forms a three-dimensional fixed abrasive element that is adhered to one surface of a backing material. Commercially available fixed abrasive articles can be obtained from Tokyo Sumitsu Kageki and Ebera Corporation, both of Japan, and Minnesota Mining and Manufacturing Company (3M Company) of St. Paul, Minn. An example of a preferred fixed abrasive article is a ceria-based pad commercially available from 3M Company under the trade designation "SWR 159."

Figure 1B:
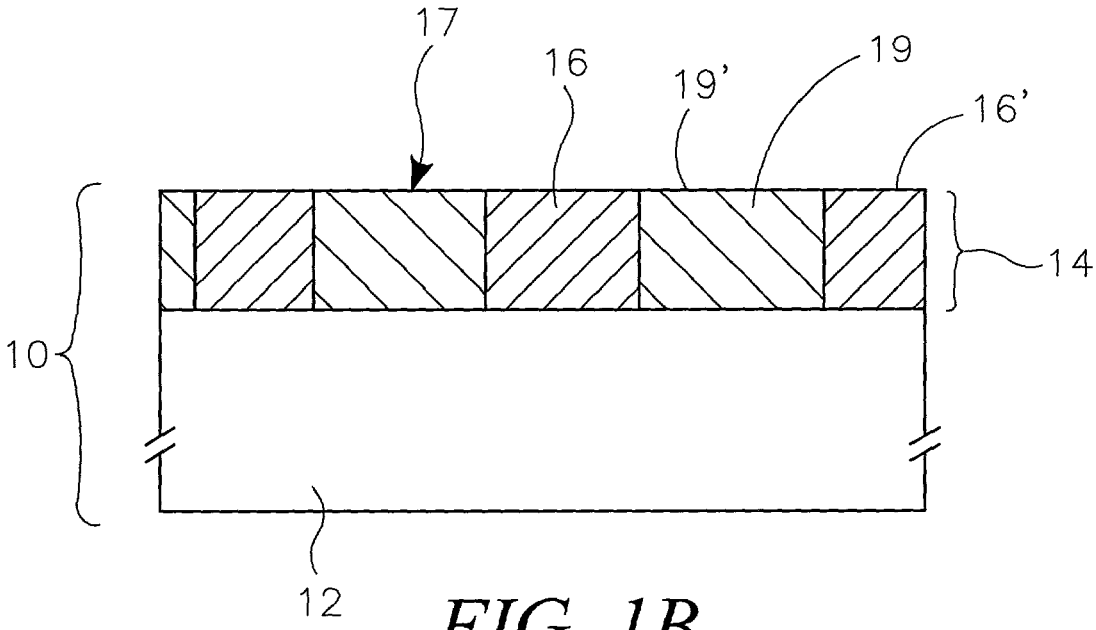

The figures provide further information about the methods of the invention. FIG. 1A illustrates one portion of a wafer 10 prior to planarization in accordance with the present invention having features that are filled with the material to be removed through planarization. The wafer portion 10 includes a substrate assembly 12 having junctions 16 formed thereon. A capacitor and/or barrier layer material 19 is then formed over the substrate assembly 12 and the junctions 16. The capacitor and/or barrier layer material 19 may be any conductive material such as platinum or any other suitable conductive second or third row Group VIII metal-containing capacitor and/or barrier material. Generally, as shown in FIG. 1A, the nonplanar upper surface 13 of capacitor and/or barrier layer 19 is subjected to planarization or other processing in accordance with the present invention. The resulting wafer 10, which is shown in FIG. 1B, includes an upper surface 17 planarized such that the thickness of the wafer 10 is substantially uniform across the entire wafer 10 so that the wafer now includes a capacitor and/or barrier structure layer 14.

Figure 2A:
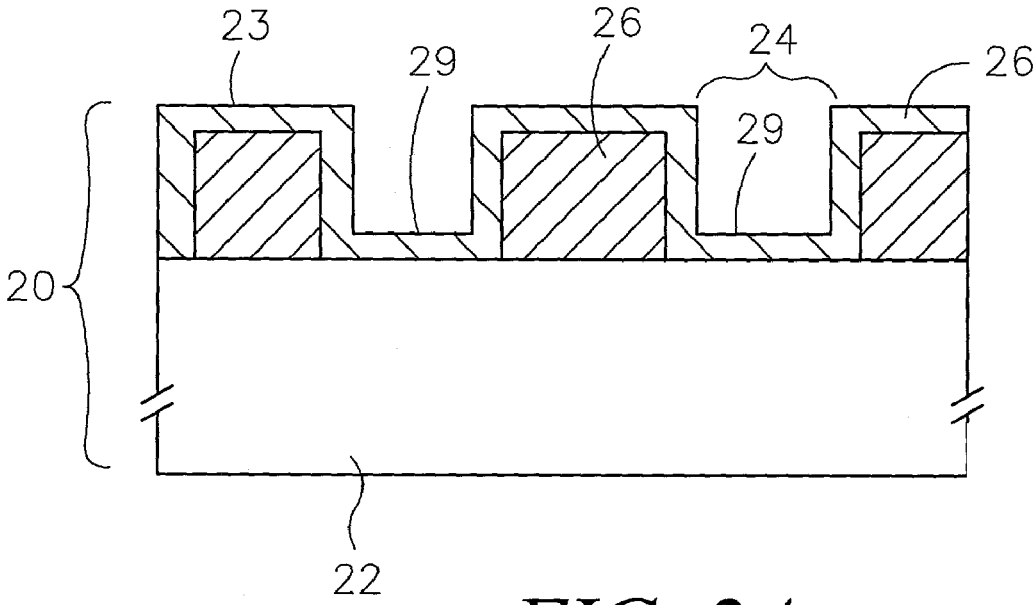
FIGS. 2A and 2B are cross-sectional illustrations of one portion of a wafer before and after a planarization process has been performed in accordance with the present invention.
Figure 2B:
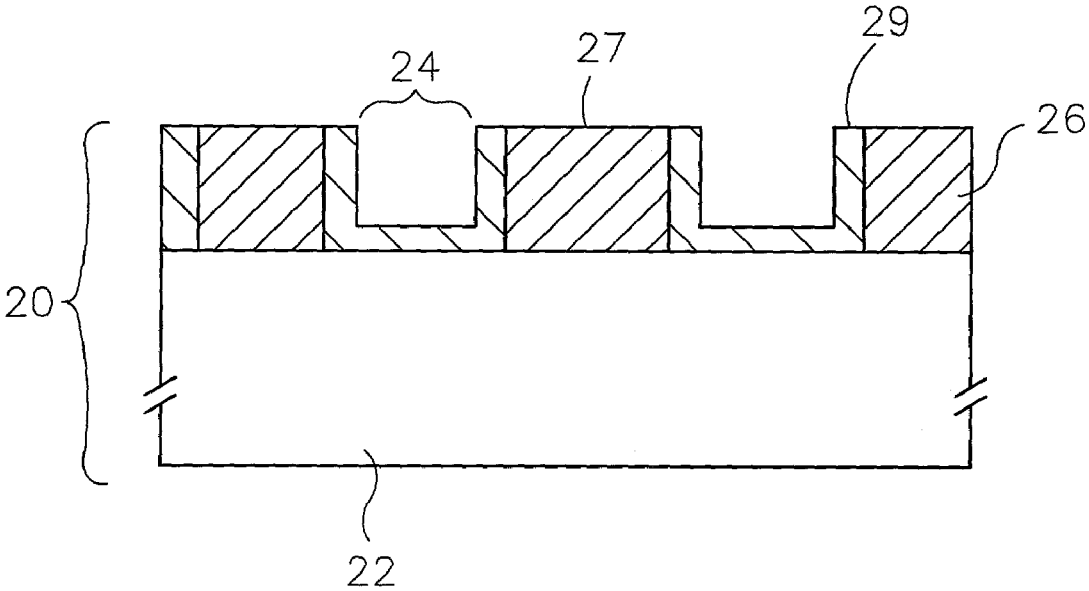

FIG. 2A illustrates one portion of a wafer 20 prior to planarization in accordance with the present invention having features that have a conformal layer of the material to be removed through planarization. The wafer portion 20 includes a substrate assembly 22 having a patterned dielectric layer 26 formed thereon. Such a patterned dielectric layer 26 can be used in a variety of structures, particularly a capacitor structure. The patterned dielectric layer 26 can be formed of any material that provides electrical isolation between metal regions (e.g., silicon dioxide, silicon nitride, or BPSG). An electrode layer 29 is then formed over the substrate assembly 22 and the patterned dielectric layer 26. The electrode layer 29 may be platinum or any other suitable conductive second or third row Group VIIIB or Group IB metal-containing material. Generally, as shown in FIG. 2A, the nonplanar upper surface 23 of electrode layer 29 is subjected to planarization or other processing in accordance with the present invention. The resulting wafer 20, as shown in FIG. 2B, includes an upper surface 27 planarized such that the thickness of the wafer 20 is substantially uniform across the entire wafer 20 so that the wafer now includes electrically conducting regions 24 isolated within the patterned dielectric material 26 forming a capacitor structure. If desired, prior to planarization, the conformal layer 29 and openings 24 can be covered with a photoresist or other material that is removed after the planarization so the abrasive does not fall into the openings 24.

Figure 3:
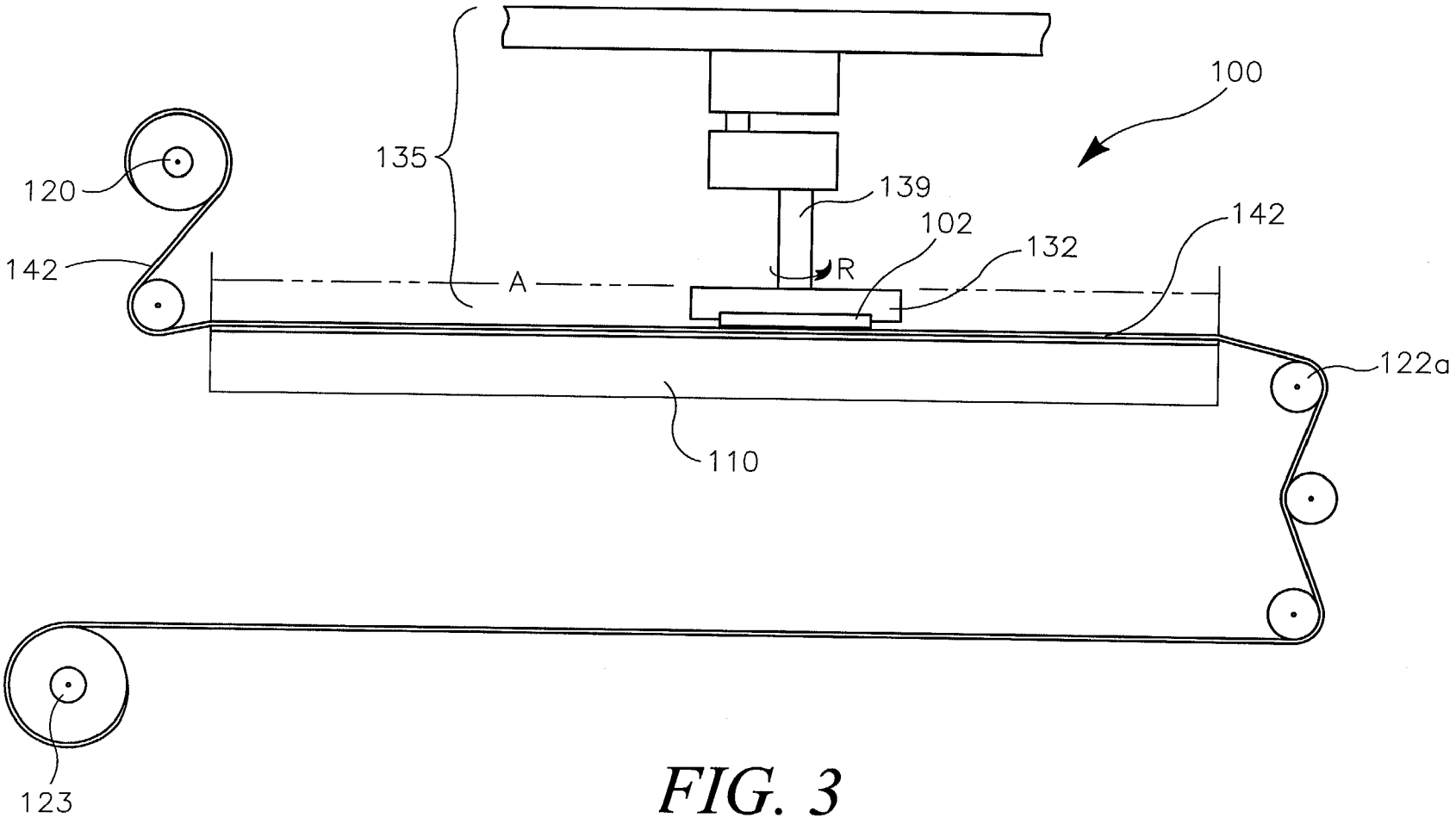
FIG. 3 is a general diagrammatical illustration of a chemical-mechanical polishing system utilized in accordance with the present invention.

One generally illustrated planarization assembly 100, as shown in FIG. 3, includes a revolving wafer carrier platform 135 that holds wafer 102 of which wafer portion 10 (shown in FIGS. 1A and 1B) is a part thereof. A planarization composition is typcially introduced at or near the interface between the fixed abrasive article 142 and the wafer 102. A fixed abrasive article 142 is then supplied between a platen 110 and the wafer 102.

As shown in FIG. 3, the fixed abrasive article 142 may be supplied in a continuous manner, wherein a supply roll 120 feeds an elongated fixed abrasive article 142 to a polishing interface between the platen 110 and the wafer 102. After the polishing life of a portion of the fixed abrasive article 142 has been exhausted, the fixed abrasive article 142 can be advanced and is wound up on a take-up roll 123. Alternatively, a fixed abrasive article of a defined size may be attached to the platen 110 for use in a discrete manner, i.e., not continuous.

Optionally, a station (not shown) may be provided that can serve to pre-wet the fixed abrasive article prior to planarization or it can serve to flush the fixed abrasive article between the planarization of different wafers. The fixed abrasive article 142 can be advanced to the station, located in close proximity to a rotating drum 122*a*, and a solution provided to the station and applied, such as by drip, spray, or other dispensing means, to the fixed abrasive surface that will ultimately contact the wafer. More preferably, the solution is an aqueous solution and, even more preferably, the solution is water or a planarization composition in accordance with the present invention. After application of the solution, the fixed abrasive article 142 is then positioned to contact the surface of the wafer for planarization.

The fixed abrasive article 142 contacts a surface of the wafer 102 (e.g., the surface 13 of wafer 10 as depicted in FIG. 1A) in the presence of a planarization composition during the planarization process. Pressure can be applied, typically by a downward force applied to a carrier arm 139 affixed the holder 132, although a backside pressure can be applied from a platen 110 is contemplated by the present invention. Preferably, a method in accordance with the present invention is conducted at atmospheric pressure and at a temperature in a range from about 4° C. to about 62° C. In one embodiment, both a wafer holder 132 and/or the platen 110 can be revolved and moved by motors or drive means (not shown) as is readily known to those skilled in the art.

Wafer holder 132 revolves wafer 102 at a selected velocity in a circular direction indicated by arrow "R" and moves wafer 102 under controlled pressure across a portion of the fixed abrasive article 142. The wafer 102 contacts the fixed abrasive article 142 as it is moved. The area of the fixed abrasive article 142 which comes into contact with the surface of the wafer 102 varies as the wafer 102 is moved as is known to those skilled in the art. For example, the fixed abrasive article 142 can be moved a distance that is less than a maximum diameter of a wafer such that a subsequently polished wafer is exposed to a second position on the fixed abrasive. Preferably, the second position on the fixed abrasive includes at least a portion that was not utilized to polish the wafer immediately preceding it. Thus, all or a portion of the second position on the fixed abrasive can include a portion that was not utilized to polish the wafer immediately preceding it. One suitable distance that the fixed abrasive article 142 can be moved is less than about 1.0% of the maximum diameter of the wafer. Thus, for a wafer having a maximum diameter of about 8 inches (about 20.3 cm), a distance that the fixed abrasive article 142 can be moved is about 0.25 inch (about 0.64 cm). Another suitable distance that the fixed abrasive article 142 can be moved is a distance substantially equal to the maximum diameter of the wafer.

A supply system (not shown) introduces a planarization composition atop the fixed abrasive article 142, preferably at or near the interface or contact area between the surface of the wafer 102 and the fixed abrasive article 142 at a specified flow rate. The planarization composition may be introduced at various locations about the fixed abrasive. For example, the planarization composition may be introduced from above the fixed abrasive article 142, such as by drip, spray, or other dispensing means.

Figure 4:
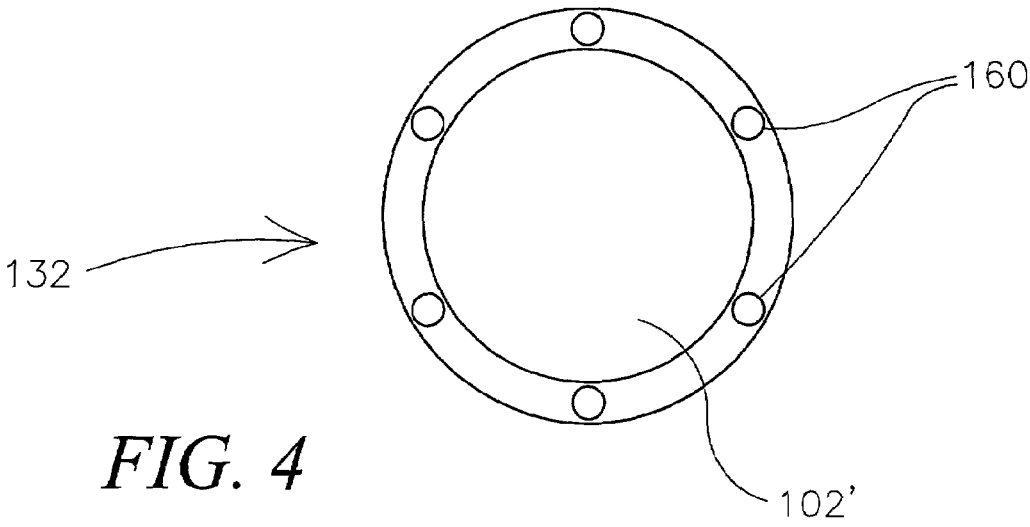
FIG. 4 is an enlarged cross-sectional view taken across line A—A of FIG. 3.

As shown in FIG. 4, taken across line A—A in FIG. 3, the composition may be introduced at or near the wafer/fixed abrasive article interface by supplying the composition to a dispensing mechanism directly incorporated in the wafer holder 132 of the wafer carrier platform 135. A plurality of supply ports 160 are arranged around the periphery of the wafer holder 132 through which the composition can be dispensed. The composition can be dispensed through all or a few of the supply ports at any given time during the planarization process. As shown in FIG. 4, one preferred arrangement of the plurality of supply ports 160 is about the circumference of a wafer attachment portion 102' of the wafer holder 132, although other arrangements are possible.

Figure 5:
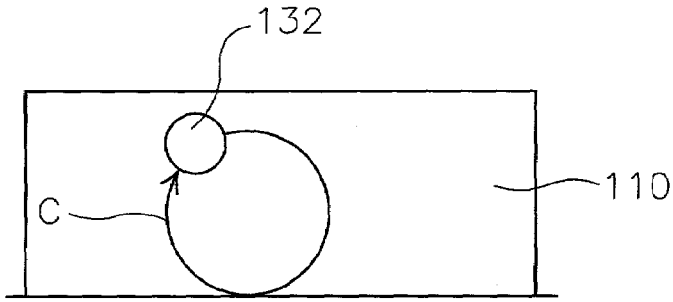
FIG. 5 is a schematic of one operation of a process in accordance with the present invention.

The wafer holder 132 is preferably revolved at a speed of about 200–600 millimeters per second. As shown in FIG. 5, the wafer holder 132 preferably revolves in a path designated by arrow "C" in contact with the platen 110 including the fixed abrasive article 142. The speed of the wafer holder 132 is then related to the length of "C." The surface of the wafer 102 is held in juxtaposition relative to the fixed abrasive article 142 so that the fixed abrasive article 142 can planarize the surface.

Although the foregoing has been described with particular attention to a revolving wafer holder, it is to be understood that for planarization both the wafer holder and the platen can move relative to one another. For example, the wafer holder can revolve/rotate and the platen can revolve or orbit. Further, either the wafer holder or the platen can be stationary.

The foregoing detailed description has been given for clarity of understanding only. No unnecessary limitations are to be understood therefrom. The invention is not limited to the exact details shown and described, for variations obvious to one skilled in the art will be included within the invention defined by the claims. For example, while the description above focused on planarization of semiconductor-based substrates, the compositions and methods of the invention are also applicable to, for example, polishing glasses and contact lenses, as one of many other possible applications. The complete disclosures of all patents, patent documents, and publications listed herein are incorporated by reference, as if each were individually incorporated by reference.

What is claimed is:

1. A planarization method comprising:

providing a semiconductor substrate or substrate assembly including at least one region of a platinum-containing surface having a nonplanar topography;

providing a fixed abrasive article;

providing a planarization composition at an interface between the at least one region of platinum-containing surface and the fixed abrasive article; and planarizing the at least one region of platinum-containing surface with the fixed abrasive article to remove platinum-containing material;

wherein the fixed abrasive article comprises a plurality of abrasive particles having a hardness of no greater than about 6.5 Mohs dispersed within a binder adhered to at least one surface of a backing material;

wherein the rate of removal of the platinum-containing material is greater than the rate of removal of material from a generally planar surface of the same material under the same conditions.

2. The method of claim 1 wherein the platinum is present in an amount of about 10 atomic percent or more.

3. The method of claim 1 wherein the platinum-containing surface comprises elemental platinum.

4. The method of claim 1 wherein the platinum-containing surface comprises a platinum alloy.

5. The method of claim 1 wherein the substrate assembly is a wafer.

6. The method of claim 1 wherein the plurality of abrasive particles comprise $CeO_2$, $Y_2O_3$, $Fe_2O_3$, or mixtures thereof.

7. The method of claim 6 wherein a majority of the plurality of abrasive particles are $CeO_2$ abrasive particles.

8. The method of claim 1 wherein the planarization composition comprises an oxidizing agent, a complexing agent, or mixtures thereof.

9. The method of claim 1 wherein the platinum-containing surface is removed relative to an oxide layer at a selectivity ratio of at least about 10:1.

10. A plan planarization method for use in forming a capacitor or barrier layer:

providing a wafer having a patterned dielectric layer formed thereon and a Group VIII metal-containing layer formed over the patterned dielectric layer, wherein the Group VIII metal is selected from the group consisting of rhodium, iridium, ruthenium, osmium, palladium, platinum, and combinations thereof; wherein the Group VIII metal-containing layer has a nonplanar topography;

positioning a first portion of a fixed abrasive article for contact with the Group VIII metal-containing layer, providing a planarization composition in proximity to the contact between the fixed abrasive and the Group VIII metal-containing layer; and planarizing the Group VIII metal-containing layer with the fixed abrasive article to remove Group VIII metal-containing material;

wherein the fixed abrasive article comprises a plurality of abrasive particles having a hardness of no greater than about 6.5 Mohs dispersed within a binder adhered to at least one surface of a backing material;

wherein the rate of removal of the Group VIII metal-containing material is greater than the rate of removal of material from a generally planar surface of the same material under the same conditions.

11. The method of claim 10 wherein the Group VIII metal-containing surface of the substrate comprises a Group VIII metal in elemental form or an alloy thereof.

12. The method of claim 11 wherein the Group VIII metal-containing surface comprises elemental platinum.

13. The method of claim 10 wherein the Group VIII metal-containing surface comprises a platinum alloy.

14. The method of claim 10 wherein the Group VIII metal is present in an amount of about 10 atomic percent or more.

15. The method of claim 14 wherein the Group VIII metal is present in an amount of about 20 atomic percent or more.

16. The method of claim 15 wherein the Group VIII metal is present in an amount of about 50 atomic percent or more.

17. The method of claim 10 wherein the plurality of abrasive particles comprise $CeO_2$, $Y_2O_3$, $Fe_2O_3$, or mixtures thereof.

18. The method of claim 17 wherein a majority of the plurality of abrasive particles are $CeO_2$ abrasive particles.

19. The method of claim 10 wherein the planarization composition comprises an oxidizing agent, a complexing agent, or mixtures thereof.

20. The method of claim 10 wherein the Group VIII metal-containing surface is removed relative to an oxide layer at a selectivity ratio of at least about 10:1.

21. A planarization method comprising:

positioning a Group VIII metal-containing surface of a substrate to interface with a fixed abrasive article, wherein the Group VIII metal is selected from the group consisting of rhodium, iridium, ruthenium, osmium, palladium, platinum, and combinations thereof; wherein the surface of the substrate has a nonplanar topography;

supplying a planarization composition in proximity to the interface; and planarizing the substrate surface with the fixed abrasive article to remove Group VIII metal-containing material;

wherein the fixed abrasive article comprises a plurality of abrasive particles having a hardness of no greater than about 6.5 Mohs dispersed within a binder adhered to at least one surface of a backing material; and wherein the rate of removal of the Group VIII metal-containing material is greater than the rate of removal of material from a generally planar surface of the same material under the same conditions.

22. The method of claim 21 wherein the Group VIII metal-containing surface of the substrate comprises a Group VIII metal in elemental form or an alloy thereof.

23. The method of claim 22 wherein the Group VIII metal-containing surface comprises elemental platinum.

24. The method of claim 22 wherein the Group VIII metal-containing surface comprises a platinum alloy.

25. The method of claim 21 wherein the Group VIII metal is present in an amount of about 10 atomic percent or more.

26. The method of claim 25 wherein the Group VIII metal is present in an amount of about 20 atomic percent or more.

27. The method of claim 26 wherein the Group VIII metal is present in an amount of about 50 atomic percent or more.

28. The method of claim 21 wherein the substrate is a wafer.

29. The method of claim 21 wherein the plurality of abrasive particles are selected from the group consisting of $CeO_2$, $Y_2O_3$, $Fe_2O_3$, and mixtures thereof.

30. The method of claim 29 wherein a majority of the plurality of abrasive particles are $CeO_2$ abrasive particles.

31. The method of claim 21 wherein the planarization composition comprises an oxidizing agent, a complexing agent, or mixtures thereof.

32. The method of claim 21 wherein the Group VIII metal-containing surface is removed relative to a dielectric layer at a selectivity ratio of at least about 10:1.

33. The method of claim 21 wherein the rate of removal of the Group VIII metal-containing material is at least about 10 times greater than the rate of removal of material from a generally planar surface of the same material under the same conditions.

34. The method of claim 21 wherein the rate of removal of the Group VIII metal-containing material is at least about 25 times greater than the rate of removal of material from a generally planar surface of the same material under the same conditions.

* * * * *

UNITED STATES PATENT AND TRADEMARK OFFICE

CERTIFICATE OF CORRECTION

PATENT NO. : 7,121,926 B2
APPLICATION NO. : 10/028616
DATED : October 17, 2006
INVENTOR(S) : Gundu M. Sabde It is certified that error appears in the above-identified patent and that said Letters Patent is hereby corrected as shown below:

Title page item (56), Page 2, under Foreign Patent Documents, delete "WO 99/553532" and insert --WO 99/53532--.

Column 6, line 11, insert the following paragraph -- It is to be understood that a planarization composition suitable for use in the methods of the present invention is preferably essentially free of abrasive particles when supplied to the interface of the fixed abrasive article and the workpiece surface. However, it is contemplated that planarization is accomplished by one or both of the fixed abrasive article and/or abrasive particles that may be removed from the fixed abrasive article at the fixed abrasive/ surface interface in combination with the planarization composition. In any event, abrasive particles are typically not present in the composition as initially applied, i.e., they are not supplied from a source external to the polishing interface-- .

Column 9, line 29, Claim 10, delete "plan".

Signed and Sealed this

Ninth Day of January, 2007

JON W. DUDAS
*Director of the United States Patent and Trademark Office*